US012366040B2

(12) United States Patent
Resio et al.

(10) Patent No.: US 12,366,040 B2
(45) Date of Patent: Jul. 22, 2025

(54) TRACK MAINTENANCE MACHINE AND MEASUREMENT METHOD FOR A TRACK MAINTENANCE MACHINE

(71) Applicant: Plasser American Corporation, Chesapeake, VA (US)

(72) Inventors: James Resio, Virginia Beach, VA (US); Francesco G Lezzi, Chesapeake, VA (US); Hakki Hakan Uzuner, Virginia Beach, VA (US)

(73) Assignee: Plasser American Corporation, Chesapeake, VA (US)

( * ) Notice: Subject to any disclaimer, the term of this patent is extended or adjusted under 35 U.S.C. 154(b) by 719 days.

(21) Appl. No.: 17/734,258

(22) Filed: May 2, 2022

(65) Prior Publication Data

US 2023/0349106 A1 Nov. 2, 2023

(51) Int. Cl.
*E01B 35/06* (2006.01)
*B61K 9/08* (2006.01)
(Continued)

(52) U.S. Cl.
CPC ..... *E01B 35/06* (2013.01); *B61K 9/08* (2013.01); *B61L 23/045* (2013.01); *E01B 27/16* (2013.01); *E01B 35/00* (2013.01); *E01B 2203/16* (2013.01)

(58) Field of Classification Search
CPC ..... B61K 9/08; B61L 23/045; E01B 27/16; E01B 35/00; E01B 35/06; E01B 35/08; E01B 35/10; E01B 35/12; E01B 2203/16
See application file for complete search history.

(56) References Cited

U.S. PATENT DOCUMENTS 3,706,284 A * 12/1972 Plasser ..... G01C 15/004 299/1.5
4,031,625 A * 6/1977 Theurer ..... E01B 35/00 104/8

(Continued)

FOREIGN PATENT DOCUMENTS

WO WO-9514817 A1 * 6/1995 ..... E01B 35/00

OTHER PUBLICATIONS

BallastSaver Loram Technologies, Maintenance of Way Inspection & Optimization Geotechnical & Substructure Maintenance GPR LIDAR Ballast Saver Resources Company, https://loram.com/inspection-and-optimization/geotechnical-services/ballastsaver/, pp. 1/4.

(Continued)

*Primary Examiner* — S. Joseph Morano
*Assistant Examiner* — Cheng Lin
(74) *Attorney, Agent, or Firm* — Laurence A. Greenberg; Werner H. Stemer; Ralph E. Locher

(57) ABSTRACT

A track maintenance machine, with a sensor for identifying an A-point of a chord, having a frame, axles, and wheels operatively connected to the axles and configured to support the machine on a track. A workhead is arranged between the axles. A B-point is placed at the workhead at a predetermined height above the track, and a C-point placed at a rear end of the at a predetermined height above the track. A sensor is arranged at a forward end of the frame at a predetermined height above the track. The sensor scans forward of the machine to identify an A-point; acquire track data for the A-point; and transmit the data to a machine control system. The machine control system is configured to calculate a chord by combining the track data for the A-point with the C-point to calculate operation data for the workhead at the B-point.

20 Claims, 2 Drawing Sheets

(51) Int. Cl.

| | |
|---|---|
| ***B61L 23/04*** | (2006.01) |
| ***E01B 27/16*** | (2006.01) |
| ***E01B 35/00*** | (2006.01) |

(56) References Cited

U.S. PATENT DOCUMENTS

| | | | | |
|---|---|---|---|---|
| 4,625,651 | A * | 12/1986 | Theurer | E01B 27/16 104/7.2 |
| 4,655,142 | A * | 4/1987 | Theurer | E01B 35/04 104/8 |
| 5,301,548 | A * | 4/1994 | Theurer | E01B 35/00 73/146 |
| 5,598,782 | A * | 2/1997 | Wiseman | E01B 35/00 104/2 |
| 6,058,628 | A * | 5/2000 | Theurer | E01B 27/023 104/2 |
| 6,311,624 | B1 * | 11/2001 | Theurer | E01B 35/10 104/2 |
| 7,999,848 | B2 * | 8/2011 | Chew | B61L 23/041 348/148 |
| 8,081,320 | B2 * | 12/2011 | Villar | B61K 9/08 356/606 |
| 8,875,635 | B2 | 11/2014 | Turner et al. | |
| 8,958,079 | B2 * | 2/2015 | Kainer | B61L 23/045 356/625 |
| 9,175,998 | B2 | 11/2015 | Turner et al. | |
| 10,336,352 | B2 | 7/2019 | Maurice et al. | |
| 10,807,623 | B2 * | 10/2020 | Mesher | G01S 19/45 |
| 10,953,899 | B2 * | 3/2021 | Chung | B61L 15/0054 |
| 11,259,007 | B2 | 2/2022 | Mesher | |
| 11,613,852 | B2 * | 3/2023 | Auer | E01B 35/08 104/7.1 |
| 11,802,380 | B2 * | 10/2023 | Wollanek | E01B 35/12 |
| 11,920,308 | B2 * | 3/2024 | Lichtberger | E01B 35/10 |
| 2002/0078853 | A1 * | 6/2002 | Holmes | E01B 27/00 104/2 |
| 2006/0032063 | A1 * | 2/2006 | Tomasello | E01B 35/08 33/287 |
| 2012/0192756 | A1 | 8/2012 | Miller et al. | |
| 2012/0300060 | A1 * | 11/2012 | Farritor | B61K 9/08 348/125 |
| 2017/0022672 | A1 | 1/2017 | Van Cleave et al. | |
| 2023/0151556 | A1 * | 5/2023 | Philipp | E01B 27/20 104/12 |

OTHER PUBLICATIONS

LiDAR, a tool for the "virtual world"—Railway Track and Structures, Written by elaine Ball, TopoDot, RT&S (https://www.rtands.com), May 8, 2020, pp. 1/13.

Loram Maintenance of Way, Inc., Date updated: May 28, 2021, U.S. Patents Virtual Marking, Date updated: May 28, 2021.

* cited by examiner

TRACK MAINTENANCE MACHINE AND MEASUREMENT METHOD FOR A TRACK MAINTENANCE MACHINE

FIELD AND BACKGROUND OF THE INVENTION

Field

The present invention relates to a surfacing machine or tamper that utilizes a sensor based chord system.

Background

The positioning of railroad track can drastically affect the safety and performance of the railroad. Surfacing machines are used by railroads to fix and improve the geometry of the track. The most common style of surfacing machine used to fix these issues is called a "tamper". The improvement and/or repair of the track is done by measuring, lifting, and then squeezing stone under the track to support the track in the correct position.

Tamper measurement systems are based on a "chord" concept. The chord can be of multiple sizes depending on the length in which the railroad wants the error to be averaged. This chord is built of three points. The A point which is in front of the vehicle, the B point which is close to the workhead, and the C point which is at the end of the vehicle.

Surfacing vehicles come in many sizes depending on the type of rail and the region in which the railroad is located. The size of the vehicles is a factor in how the system works. When surfacing vehicles are on the smaller size (particularly in North America), buggy systems are typically extended beyond the front of the vehicle at the desired distance to create the desired chord length. A wire or light system is then used to reference the A point to the B and C points to create a geometrical chord. The extension of this buggy is time consuming, creates safety hazards, and limits the speed at which you can pre-record the data.

SUMMARY OF THE INVENTION

Against the background of known methods and devices for surfacing machine measurement systems, it is accordingly an object of the invention to improve the measurement process, remove the need for a buggy system, increase time efficiency during operation, improve safety, and increase speed of recoding runs.

With the advancement in sensors such as lidar, computer vision, or radar; a sensor can be mounted on the front of the tamper to find the A point at whatever the desired length. This sensor may be mounted directly on the machine or on a small buggy directly in front of the machine. By utilizing sensors in this fashion, the A point can be identified by scanning forward and the proper distance to get the track values for the A point of the chord. This data is then passed to the control system. By utilizing these sensors to look forward, instead of pushing a buggy system out and looking backwards, the entire buggy system can be removed.

The B and C points can then be found through traditional wire or shadow board methods. Additionally, the B and C points can be found by either using the new sensor or adding an additional sensor(s) to look backwards and finding the top of the buggies creating the B and C locations. Through these sensors the desired A, B, and C points for the desired chord length can be found and utilized during a pre-recording run or as the working reference system An additional advantage of this system is that it can be utilized for a high-speed recording run. A high-speed recording run is a measurement pass higher then the recording speed with the buggy extended, up to the max speed of the vehicle. This can be done as the sensor can consistently pick up the A, B, and C points needed for the chord as it proceeds down the track. This method will require the tamper to move the distance of one full chord length so that the C point can be identified. Once this distance is passed the chords can be found repeatedly for use by the tamper during its work run. This data can also be transported to other tampers or sent to a back office to be utilized as geometry data.

With the foregoing and other objects in view there is provided, in accordance with the invention, a track maintenance machine, comprising:

- a frame having at least two axles and at least two wheels operatively connected to each the axle and configured to support the track maintenance machine on a track;
- a workhead arranged between the axles;
- a machine control system;
- an engine configured to propel the track maintenance machine along the track;
- a B point set at or near the workhead at a predetermined height above the track, and a C point set at a rear end of the frame in a movement direction of the track maintenance machine at a predetermined height above the track;
- a sensor arranged at a forward end of the frame in a movement direction of the track maintenance machine and at a predetermined height above the track;
- the sensor being configured to:
  - scan forward of the track maintenance machine to identify an A point,
  - acquire track data values for the A point, and
  - transmit the track data values to the machine control system,
- the machine control system being configured to:
  - calculate a chord by combining the track data values for the A point with the C point to calculate operation data for the workhead at the B point.

In a preferred embodiment of the track maintenance machine according to the invention, the B point and the C point are wire anchors or shadow board light sources.

In a preferred embodiment of the track maintenance machine according to the invention, the B point and the C point are sensor or machine-readable tags.

In a preferred embodiment of the track maintenance machine according to the invention, the sensor is a plurality of sensors.

In a preferred embodiment of the track maintenance machine according to the invention, the sensor is a LIDAR sensor.

In a preferred embodiment of the track maintenance machine according to the invention, the sensor is computer vision sensor.

In a preferred embodiment of the track maintenance machine according to the invention, the sensor is RADAR sensor.

In a preferred embodiment of the track maintenance machine according to the invention, each sensor of the plurality of sensors is selected from the group consisting of LIDAR, computer vision, and RADAR.

In a preferred embodiment of the track maintenance machine according to the invention, the sensor is configured to scan backward to identify the B point and/or C point.

In a preferred embodiment of the track maintenance machine according to the invention, a further sensor is configured to identify the B point and the C point.

In a preferred embodiment of the track maintenance machine according to the invention, the sensor is configured to identify track data values for a plurality of A points.

In a preferred embodiment of the track maintenance machine according to the invention, the machine control system is configured to combine GPS and/or IMU data with the track data values for the A point and the C point to calculate operation data for the workhead at the B point.

In a preferred embodiment of the track maintenance machine according to the invention, the machine control system is configured to combine historical data with the track data values for the A point and the C point to calculate operation data for the workhead at the B point.

In a preferred embodiment of the track maintenance machine according to the invention, the machine control system has a workhead controller, the workhead controller is configured to control the workhead based on the operation data.

In a preferred embodiment of the track maintenance machine according to the invention, the track maintenance machine further comprises an operator cabin on the frame, the operator cabin houses the machine control system, vehicle controls, and the workhead controller.

Furthermore, With the foregoing and other objects in view there is also provided, in accordance with the invention, a method for measuring a chord for a track maintenance machine, the method comprising:

providing a frame having at least two axles and at least two wheels operatively connected to each the axle and configured to support the track maintenance machine on a track;

providing a workhead arranged between the axles, a machine control system, and an engine configured to propel the track maintenance machine along the track;

setting a B point at or near the workhead at a predetermined height above the track;

setting a C point set at a rear end of the frame in a movement direction of the track maintenance machine at a predetermined height above the track;

providing a sensor at a forward end of the frame in a movement direction of the track maintenance machine and at a predetermined height above the track;

scanning, with the sensor, forward of the track maintenance machine to identify an A point, acquiring, with the sensor, track data values for the A point;

transmitting the track data values to the machine control system; and calculating a chord with the machine control system by combining the track data values for the A point with the C point, and calculating operation data for the workhead at the B point.

In a preferred embodiment of the method for measuring a chord for a track maintenance machine according to the invention, the method further comprises:

scanning, with the sensor, backward to identify the B point and/or C point; and acquiring, with the sensor, track data values for the B point and/or C point.

In a preferred embodiment of the method for measuring a chord for a track maintenance machine according to the invention, the method further comprises:

providing a further sensor at the forward end of the frame;

scanning, with the further sensor, backward to identify the B point and the C point; and acquiring track data values for the C point and/or B point.

In a preferred embodiment of the method for measuring a chord for a track maintenance machine according to the invention, the method further comprises:

scanning, with the sensor, forward of the track maintenance machine to identify a plurality of A points, acquiring, with the sensor, track data values for the plurality of A points.

In a preferred embodiment of the method for measuring a chord for a track maintenance machine according to the invention, the machine control system analyzes GPS, IMU, and historical data when calculating the chord and calculating operation data for the workhead at the B point Other features which are considered as characteristic for the invention are set forth in the appended claims.

Although the invention is illustrated and described herein as embodied in a track maintenance machine and measurement method for a track maintenance machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
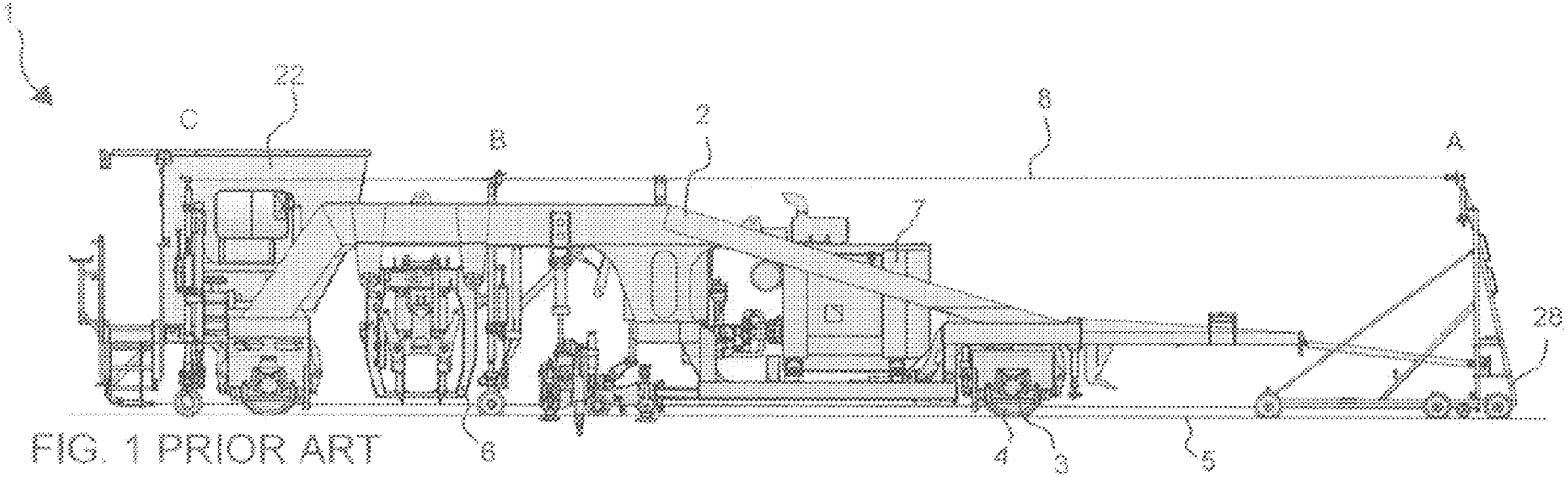
FIG. 1 PRIOR ART
FIG. 1 shows a surfacing machine having a chord system according to the prior art.

FIG. 1 shows an arrangement of a chord system 8 for a track maintenance machine 1 according to the prior art. A buggy 28 extends out in front of the surfacing machine 1 a predetermined distance and the buggy 28 has the A point for the chord 8. The B point is situated at approximately the workhead 6 of the surfacing machine 1. The C point is situated at the rear end 12 of the surfacing machine. A wire or light system is then used to reference the A point to the B and C points to create a geometrical chord 8. The extension of the buggy containing the A point is time consuming, creates safety hazards, and limits the speed at which you can pre-record the data.

Figure 2:
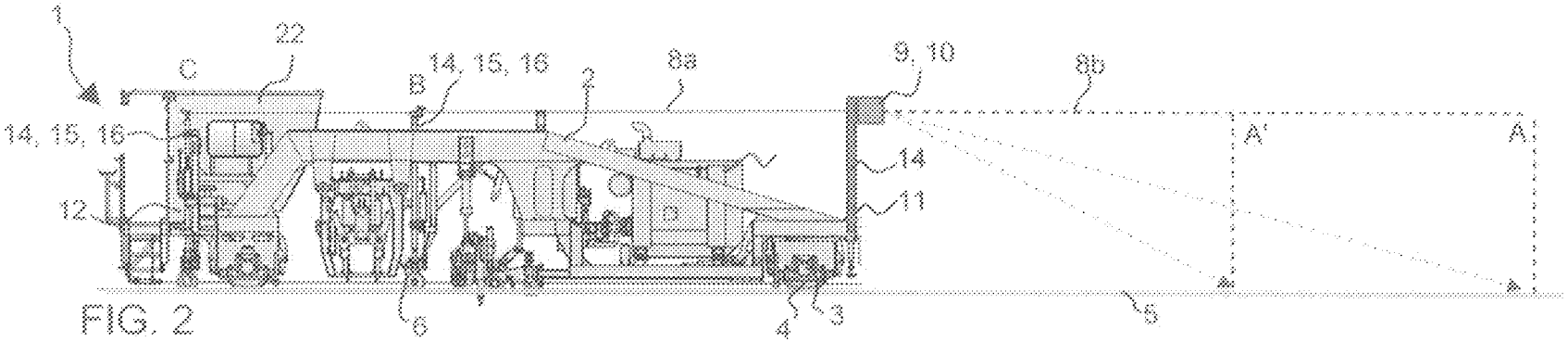
FIG. 2 shows a surfacing machine with a sensor-based chord system according the invention.

FIG. 2 shows an arrangement of a track maintenance machine 1 and chord 8 system according to a preferred embodiment of the present invention. The surfacing machine 1 has no buggy 28; but, rather, the surfacing machine 1 has a sensor 9 mounted at a forward point 11 (in a travel direction) of the surfacing machine 1. The sensor 9 may be mounted directly to the surfacing machine frame 2. Alternatively, the sensor may be mounted to anchors 14 configured to allow the sensor 9 to move according to the contour of the track 5 independent of the machine frame 2. The sensor 9 may be lidar, computer vision, radar, or other suitable sensor and imaging devices. The sensor 9 scans forward of the surfacing machine 1 to identify the A point and to identify the proper distance to get the track values 13 for the A point of the chord 8. The sensor data (track values) 13 is transmitted to the control system 19. The sensor 9, data can be transmitted to the machine control system 19 via a wired connection. The sensor 9 data can be transmitted to the machine control system 19 via a wireless connection. The sensor data 13 can be transmitted to the machine control system 19 via a combination of wired and wireless connection.

As shown in FIG. 2, the entire buggy 28 system as known is removed. By utilizing sensors 9, 10 to look forward, the buggy 28 no longer is required to be pushed out from the surfacing machine 1 to look backwards. In an alternative embodiment, the sensor(s) 9, 10 may be mounted to a small buggy 28 directly forward of the surfacing machine 1. In this embodiment the entire buggy 28 system is not removed; however, some of the significant problems with the traditional buggy 28 system are alleviated.

In an alternative embodiment, multiple sensors 9, 10 may be used. Any combination of lidar, computer vision, and/or radar imaging can make up the multitude of sensors 10. The sensors 10 may be mounted at the same forward point of the surfacing machine 1, on a small buggy 28 directly forward of the surfacing machine 1, or at any position that will effectuate the desired measurements. The sensors 10 scan forward of the surfacing machine 1 to identify the A point and to identify the proper distance to get the track values for the A point of the chord 8. The data 13 of the sensors 9, 10 is transmitted to the control system 19. The sensors 9, 10 data 13 can be transmitted to the machine control system 19 via a wired connection. The sensors 9, 10 data 13 can be transmitted to the machine control system 1 via a wireless connection. The sensors 9, 10 data 13 can be transmitted to the machine control system 19 via a combination of wired and wireless connection.

In a preferred embodiment, the B point and the C point can be found through the traditional wire 14 method or shadow board 15 method.

In further embodiments, the B point and/or the C point can be found by the same sensor(s) 9, 10 that are used for the A point. Alternatively, the B point and/or the C point can be found by an additional sensor(s) 10 configured to look backwards and find the top of the buggies creating the B and C locations. The additional sensor(s) 10 may be mounted at the same forward point 11 of the surfacing machine 1, on a small buggy 28 directly forward of the surfacing machine 1, or at any position that will effectuate the desired measurements.

In further embodiments, any combination of sensors 9, 10—lidar, computer vision, radar, or other suitable sensor and imaging devices—may be utilized for identifying the A point, B point, and C point. Through the sensor(s) 9, 10 the desired A, B, and C points for the desired chord 8 length can be found and utilized during a pre-recording run or as the working reference system.

In one embodiment, the track maintenance machine 1 according to the invention is a tamper 1. The tamper 1, or on-track tamper, is a self-propelled rail vehicle having a workhead 6 used to pack ballast under railway tracks 5 and correct alignment of the rails to make parallel and level. The tamper 1 can have a main frame 2, an operator's cabin 22, two axles 3 each having two rail wheels 4, and a workhead 6 between the axles 3. Along the length of the vehicle frame 2, in the direction of travel, a sensor 9 position is set at a front point 11, a B point is set at or near the workhead 6, and a C point is set at a rear position 12. Each of these points are preferably set on an anchorage 14; simply, an instrument that is connected to the vehicle frame 2 and the set point (sensor, B point, C point), and configured to allow the set point to move freely from the vehicle frame 2—i.e., according to the contour of the track 5 at which the set point is when measurement is taken. Optionally, the sensor 9 point is fixed to the machine frame 2 and the sensor compensates for the relationship between the rail contour and machine frame 1. The operators' cabin 22 contains a controller 25 that allows the operator to control 23 the vehicle, the measurement system 26, and the workhead 24. The tamper 1 is configured to lift, align, level, and tamp.

Track maintenance machine 1 according to the invention uses chord measurement system 8 to correct track geometry and other maintenance. The chord system 8 uses three points-A point, B point and C point.

The A point, the front reference point, is in front of the machine at uncorrected track. The sensor 9 sits at the front of the machine where it can see forward of the machine 1 to identify the A point. The sensor 9 may sit on an anchorage 14 that moves and compensates for defects in track 5 geometry.

In a further embodiment, the sensor 9 is configured to identify multiple A points forward of the machine 1. The multiple A points can be used in calculating the chord 8. The multiple A points can also be used for identifying spurious data. When multiple A points are used, the system can recognize erroneous readings and/or data outliers that should not be used in calculating the chord 8.

The B point, the middle reference point, is arrange at, or as closed as possible to, the workhead 6 of the machine 1. The machine control system 19 uses the workhead 6 at the B point to position the track 5 accurately. The C point, the rear reference point, is used for lifting and lining chords 8. Generally, the three set points-A point or sensor position, B point, and C point—are configured to freely move up, down, left and right independent of the surfacing machine's chassis 1. This allows the points to follow minor variability in rail position. Optionally, the sensor point is fixed to the machine frame 1 and the sensor 9 or machine control system 19 is used compensate for the relationship between the rail contour and machine frame 2.

In one embodiment, the B point and C point can be set through traditional wire method. The B point and C point are arranged on traditional anchorages 14 with a wire to measure the partial chord 8*a* that can be combined with the sensor reading chord 8*b* to measure the chord 8 for the machine 1. The B point and C point can also be set using a traditional shadow board method 15. The B point and C point are arranged on traditional anchorages 14 with light sources 15 and a separate light receiver to measure the partial chord 8*a* and can be combined with the sensor reading 8*b* to measure the chord 8 of the machine 1.

In a further embodiment, the B and C points can be found by using sensor(s) —either the same sensor(s) 9, 10 used for the A point, or additional sensor(s) 10 configured to find the B point and C point. The additional sensor(s) 10 can be arranged at, or near, the same forward position 11 as the A point sensor(s) 9, 10. The additional sensor(s) 10 can be arranged at any position along the length of the machine frame 2 that would measure an accurate chord 8. The sensors scan across the frame 2 to locate and/or create the B point and C points. Through these sensors 9, 10, the desired A, B, and C points for the desired chord 8 length can be found and utilized during a pre-recording run or as the working reference system. In addition to the traditional methods, the B point and C point can be set using sensor or machine readable tags 16 placed alongside the wire anchor 14 or light source 15 of the B and C point. Alternatively, the sensor or machine-readable tags 16 can replace the traditional wire and light source.

Figure 3:
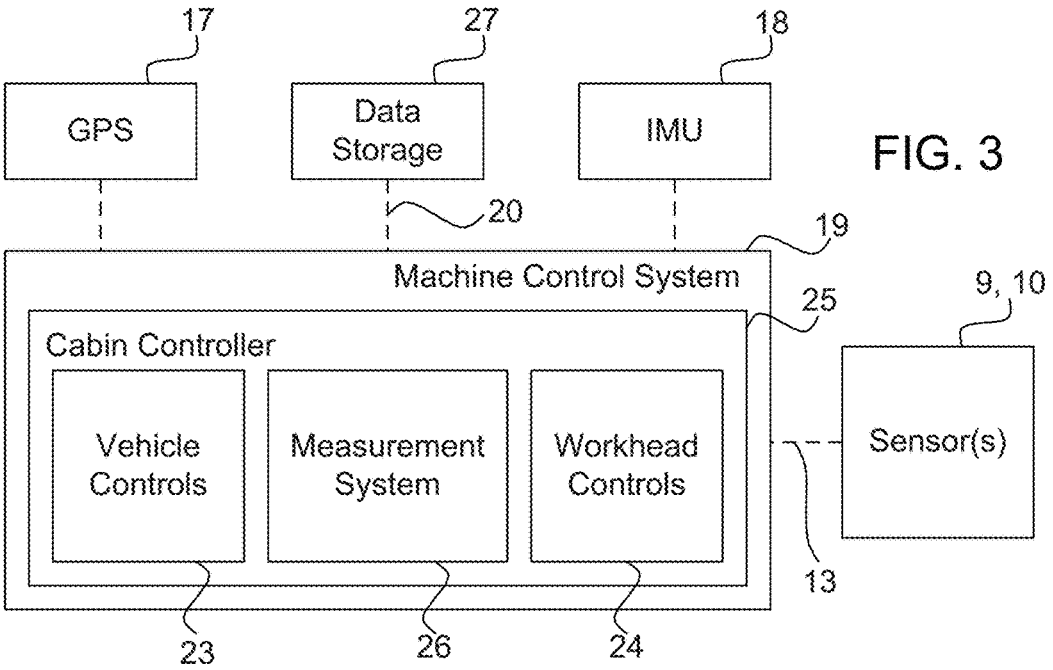
FIG. 3 shows block diagram of the machine control system, sensor, and other relevant parts of the machine.

FIG. 3 shows the machine control system 19 and relevant interactions between the other controls and data inputs. The machine control system 19 can be configured to receive and analyze data 13 from the sensor(s) 9, 10, GPS 17, IMU 18, and data storage 27 (historical data 20). The machine control system 19 can also be configured to interact with a cabin controller 25, vehicle controls 23, measurement system 26, and workhead controls 24. In this way, the entire system can be configured to be controlled from a single system 19 or position by an operator(s), or automatically through the system 19 under supervision by the operator(s).

Figure 4:
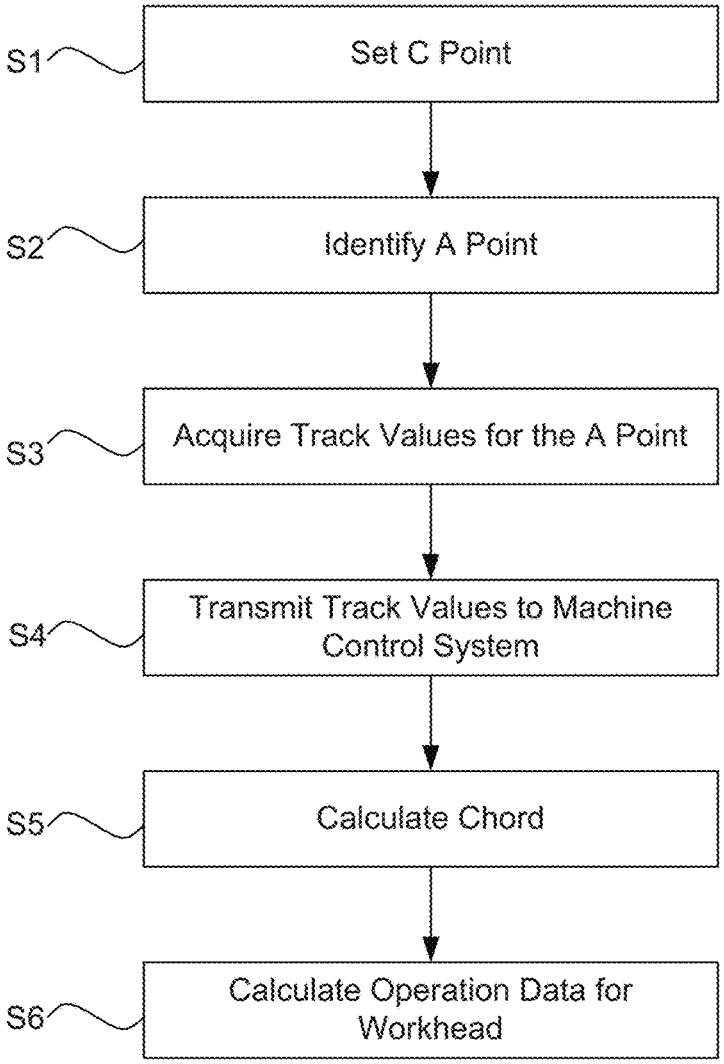
FIG. 4 shows a flowchart of the process of setting the chord of the machine.

FIG. 4 shows the process of setting the chord 8 of the machine 1, where the operator locates and positions the A point according to previous measurements 20 and/or current sensor readings 13. After the A point is positioned, the C point is assumed to be in correct position, the machine 1 begins work at the B point—e.g., the machine 1 corrects the track at the B point to be in line with the A point and C point. The machine system 19 can also locate the A point(s) automatically based on the sensor(s) readings 13, or in combination with other data 17, 18, 20 and control inputs.

Historical data 20 can be used in combination with current and/or recent sensor data 13 when calculating the chords 8. Historical data 20 informs track condition. Historical data 20 can be in the form of previous sensor data 13 of the machine 1 or other machines, weather and climate data, track condition reports, or any other suitable data points that effectuated efficient track data.

Lidar devices use light in the form of a pulsed laser to measure ranges and variable distances by targeting an object or a surface with a laser and measuring the time for the reflected light to return to the receiver. The light pulses can be combined with other data recorded by other systems (e.g., Global Positioning Systems ("GPS") and Inertial Measurement Unit ("IMU")) to generate precise, three-dimensional information. Lidar can use ultraviolet, visible, or near infrared light to image objects. As a general matter, lidar can be used to target various objects—e.g., non-metallic objects, rocks, molecules and chemical compounds, aerosols, etc. Wavelengths used in lidar vary in correspondence to the desired target. They typically range from 10 micrometers (infrared) to around 250 nm (UV). Commonly, Lidar utilizes a backscattering of reflected light instead of sheer reflection seen in mirrors. se a light is reflected via backscattering, as opposed to pure reflection one might find with a mirror. The types of scattering vary depending on application.

Computer vision is method used to acquire information from digital images and/or video. A computer or control device acquires, processes, and analyses digital images to extract data (e.g., numerical information, symbolic information, etc.) from the subjects of the digital images. Computer vision can utilize video sequences, still images, views from multiple cameras, and multi-dimensional scanners. Computer vision can automatically extract information, analyses, and or understand useful information using a single image or multiple.

Radar systems, or imaging radar, can be used for two-dimensional and three-dimensional imaging. Radar imaging, generally, involves radio wave emission and receiving the reflection of the radio wave. The radar system uses the information from this process to generate data that can be used for creating an image(s). The system uses the reflected radio waves to detect information, such as changes in the radio wave, to infer data about what the radio wave reflect from—e.g., distance, material, density, shape, etc. Some advantages of a radar imaging system is that it can penetrate obstacles such as water and other natural barriers as well as walls and other constructed barriers.

The sensor-based track maintenance machine 1 as described can be used in a conventional tamping pace. In addition, the system can be used for a high-speed recording run. That is, a high-speed recording run-a measurement pass of the machine at a higher than a recording speed with a buggy extended-up to a maximum speed of the vehicle. This can be done as the sensor can consistently pick up the A, B, and C points needed for the chord as it proceeds down the track. This method will require the tamper to move the distance of one full chord length so that the C point can be identified. Once this distance is passed the chords can be found repeatedly for use by the tamper during its work run. This data can also be transported to other tampers or sent to a back office to be utilized as geometry data.

The following is a summary list of reference numerals and the corresponding structure used in the above description of the invention:

track maintenance machine 1
frame 2
axles 3
wheels 4
track 5
workhead 6
engine 7
A point A
Plurality of A point(s) A'
B point B
C point C
chord 8
partial chords 8*a*, 8*b*
Sensor 9
Further sensors 10
forward end of the frame 11
rear end of the frame 12
track data values 13
anchorage 14
shadow board light sources 15
machine-readable tags 16
GPS 17
IMU 18
machine control system 19
historical data 20
workhead controller 21
operator cabin 22
vehicle controls 23
workhead controller 24
cabin controller 25
measurement system 26
data storage 27
buggy 28

The invention claimed is:

1. A track maintenance machine, comprising:

a frame having at least two axles and at least two wheels operatively connected to each said axle and configured to support the track maintenance machine on a track;

a workhead arranged between said axles;

a machine control system;

a B point set at or near the workhead at a predetermined height above the track, and a C point set at a rear end of said frame in a movement direction of the track maintenance machine at a predetermined height above the track;

a sensor arranged at a forward end of said frame in a movement direction of the track maintenance machine and at a predetermined height above the track;

said sensor being configured to:

scan forward of the track maintenance machine to identify an A point, acquire track data values for said A point, and transmit said track data values to said machine control system, said machine control system being configured to:

calculate a chord by combining said track data values for said A point with said C point to calculate operation data for said workhead at said B point.

2. The track maintenance machine according to claim 1, wherein said B point and said C point are wire anchors or shadow board light sources.

3. The track maintenance machine according to claim 1, wherein said B point and said C point are sensor or machine-readable tags.

4. The track maintenance machine according to claim 1, wherein said sensor is a plurality of sensors.

5. The track maintenance machine according to claim 4, wherein each sensor of said plurality of sensors is selected from the group consisting of LIDAR, computer vision, and RADAR.

6. The track maintenance machine according to claim 1, wherein said sensor is a LIDAR sensor.

7. The track maintenance machine according to claim 1, wherein said sensor is computer vision sensor.

8. The track maintenance machine according to claim 1, wherein said sensor is RADAR sensor.

9. The track maintenance machine according to claim 1, wherein said sensor is configured to scan backward to identify said B point and/or C point.

10. The track maintenance machine according to claim 1, comprising a further sensor configured to identify said B point and said C point.

11. The track maintenance machine according to claim 1, wherein said sensor is configured to identify track data values for a plurality of A points.

12. The track maintenance machine according to claim 1, wherein said machine control system is configured to combine GPS and/or IMU data with said track data values for said A point and said C point to calculate operation data for said workhead at said B point.

13. The track maintenance machine according to claim 1, wherein said machine control system is configured to combine historical data with said track data values for said A point and said C point to calculate operation data for said workhead at said B point.

14. The track maintenance machine according to claim 1, wherein said machine control system has a workhead controller, said workhead controller being configured to control said workhead based on said operation data.

15. The track maintenance machine according to claim 1, further comprising:

an operator cabin on said frame, said operator cabin housing said machine control system, vehicle controls, and said workhead controller; and an engine configured to propel the track maintenance machine along the track.

16. A method for measuring a chord for a track maintenance machine, the method comprising:

providing a workhead arranged on the track maintenance machine;

setting a B point at or near the workhead at a predetermined height above a track;

setting a C point set at a rear end of the track maintenance machine in a movement direction at a predetermined height above the track;

providing a sensor at a forward end of the track maintenance machine in a movement direction and at a predetermined height above the track;

scanning, with the sensor, forward of the track maintenance machine to identify an A point, acquiring, with the sensor, track data values for the A point;

transmitting the track data values to the machine control system; and calculating a chord with the machine control system by combining the track data values for the A point with the C point, and calculating operation data for the workhead at the B point.

17. The method according to claim 16, further comprising:

scanning, with the sensor, backward to identify the B point and/or C point; and acquiring, with the sensor, track data values for the B point and/or C point.

18. The method according to claim 16, further comprising:

providing a further sensor at the forward end of the track maintenance machine;

scanning, with the further sensor, backward to identify the B point and the C point; and acquiring track data values for the C point and/or B point.

19. The method according to claim 16, further comprising:

scanning, with the sensor, forward of the track maintenance machine to identify a plurality of A points, acquiring, with the sensor, track data values for the plurality of A points.

20. The method according to claim 16, wherein the machine control system analyzes GPS, IMU, and historical data when calculating the chord and calculating operation data for the workhead at the B point.

* * * * *